US010538938B2

(12) United States Patent
Pompey

(10) Patent No.: US 10,538,938 B2
(45) Date of Patent: Jan. 21, 2020

(54) METHOD OF STABILIZING A PANEL

(71) Applicant: Andre Patrick Pompey, Salinas, CA (US)

(72) Inventor: Andre Patrick Pompey, Salinas, CA (US)

(73) Assignee: RV WINDSKIRT INC., Salinas, CA (US)

( * ) Notice: Subject to any disclaimer, the term of this patent is extended or adjusted under 35 U.S.C. 154(b) by 0 days.

(21) Appl. No.: 16/183,642

(22) Filed: Nov. 7, 2018

(65) Prior Publication Data

US 2019/0071890 A1 Mar. 7, 2019

Related U.S. Application Data

(62) Division of application No. 14/329,043, filed on Jul. 11, 2014, now abandoned.

(60) Provisional application No. 61/995,966, filed on Apr. 28, 2014.

(51) Int. Cl.

| | |
|---|---|
| ***E04H 15/32*** | (2006.01) |
| ***E04H 15/62*** | (2006.01) |
| *E04H 15/08* | (2006.01) |
| *E04H 15/24* | (2006.01) |

(52) U.S. Cl.

CPC ..... *E04H 15/32* (2013.01); *E04H 15/62* (2013.01); *E04H 15/08* (2013.01); *E04H 15/24* (2013.01)

(58) Field of Classification Search

CPC ..... E04H 15/32

See application file for complete search history.

(56) References Cited

U.S. PATENT DOCUMENTS

| | | | | | |
|---|---|---|---|---|---|
| 1,409,316 | A * | 3/1922 | Smith | E04H 1/1244 | 135/99 |
| 2,652,845 | A * | 9/1953 | O'Neill | E04H 15/003 | 135/90 |
| 3,224,495 | A * | 12/1965 | Truesdale | A47H 23/01 | 160/349.1 |
| 3,448,748 | A * | 6/1969 | Walrave | E04H 15/003 | 135/127 |
| 4,887,627 | A * | 12/1989 | Audet | E04H 15/64 | 135/120.1 |
| 5,427,169 | A * | 6/1995 | Saulters | E06B 3/80 | 160/332 |
| 5,970,661 | A * | 10/1999 | Bishop | E04H 15/006 | 135/125 |
| 7,871,052 | B2 * | 1/2011 | Baum | B60P 3/343 | 135/115 |
| 8,042,561 | B2 * | 10/2011 | Moravec Varga | A45B 15/00 | 135/16 |
| 9,603,423 | B1 * | 3/2017 | Skobeleva | A45B 25/18 | |
| 9,644,391 | B1 * | 5/2017 | Urhausen | E04H 15/62 | |

* cited by examiner

*Primary Examiner* — Noah Chandler Hawk

(74) *Attorney, Agent, or Firm* — JRG Attorneys at Law

(57) ABSTRACT

An enhanced fabric panel has a fabric surface with at least one straight edge, and a row of pockets implemented on the fabric along the one straight edge, the pockets each having an opening facing upward, such that with the one straight edge lying along a ground line with the pockets filled with a weighty material such as sand, pebbles, water or another material having weight, and other edges supported on parts of a rigid structure provides resistance to deformation or movement by impinging wind.

19 Claims, 11 Drawing Sheets

METHOD OF STABILIZING A PANEL

PRIORITY CLAIM

This application is a divisional application, claiming priority to co-pending U.S. patent application Ser. No. 14/329,043, filed Jul. 11, 2014, which claims priority to Provisional Patent Application No. 61/995,966, entitled "Wind Resistance", filed on Apr. 28, 2014.

BACKGROUND OF THE INVENTION

1. Field of the Invention

The present invention is in the field of consumer products and accessories and pertains particularly to methods and apparatus for blocking wind and debris from entering into a user-defined area.

2. Discussion of the State of the Art

In the field of consumer products and accessories, there are numerous aftermarket products available to users for enhancing or otherwise optimizing designated recreational areas or work site areas set up by users for socializing, eating, working, or other planned activities.

Lighting products, furniture products, shading devices, potable rooms, etc. may be available to users to optimize their outdoor recreation or work experiences. In many situations where users recreate or work outside, wind can be a serious, ongoing problem. For example, a beach or other coastal area may experience strong windy conditions that may blow sand and other debris in and around areas that are set up by the user for recreation. Roof-top construction projects may have ongoing issues with high winds blowing at higher elevations.

Users may attempt to block such winds by setting up social and dining areas or work areas on the downwind side of recreational trailers, work vehicles, or other structures. One issue with structures such as vehicles is that wind often tunnels through any open areas in or about the structure such as wind tunneling through an open area of a partition structure or underneath a trailer between the bottom frame of the trailer and the ground. Not only can the wind cause problems but it can also blow in debris from around the area further denigrating or compromising the utility area set up by the user(s). Moreover, portable structures may not be heavy or sturdy enough able to block winds of certain velocities and conversely typical items used to set up wind blocks, like portable sheets of paneling, are heavy, bulky, hard to pack, and do not always solve the problem.

In another aspect wind causes other problems such as displacing fabric structures such as tents, requiring such structures to be anchored to the ground by elaborate lines and stakes strategically placed to resist movement by wind impingement.

Therefore, what is clearly needed is a way to anchor and reinforce fabric structures to stabilize the structures and to block wind.

BRIEF SUMMARY OF THE INVENTION

In one embodiment of the invention an enhanced fabric panel is provided, comprising a fabric surface having at least one straight edge, and a row of pockets implemented on the fabric along the one straight edge, the pockets each having an opening facing upward, wherein the one straight edge lying along a ground line with the pockets filled with a weighty material such as sand, pebbles, water or another material having weight, and other edges supported on parts of a rigid structure provides resistance to deformation or movement by impinging wind.

In one embodiment the panel is one side panel of a tent structure, and other side panels of the same tent structure are also enhanced with pockets filled with weighty material. Also in one embodiment the panel is a flat panel having a width and a length, the one straight edge being one of the lengthwise edges, and the other lengthwise edge is implemented with fasteners compatible with fasteners arrayed along a rigid structure such as a camping trailer, the panel when fastened to the rigid structure with the one straight edge having weighted packets along the ground line forms a wind barrier to wind traveling under the rigid structure. Also, in one embodiment the panel is one of a plurality of panels of a tent structure made to be fastened to a rigid structure. In another embodiment the panel has hook-and-loop fasteners along one or both short edges, allowing the fabric panel in use to be connected to like panels end-to-end.

In yet another embodiment the pockets are formed by folding over an edge of the panel onto itself and providing vertical stitching to close the outer edges of the fold and on the interior of the folded panel at locations along the length, defining the individual pockets. Also, in one embodiment the pockets are formed separately and are attachable to the one straight edge of the panel with the pocket orientation of individual ones of or of the plurality of the pockets retained by one or more clips, fasteners, cords, wires, or rods. And in one embodiment the plurality of pockets or individual ones thereof may be disoriented from their positions on the panel to spill their contents by manually removing the retainer mechanism holding the individual ones of or the plurality of pockets in position.

In another aspect of the invention a method for stabilizing a fabric panel against impinging wind is provided, comprising steps of (a) forming a row of pockets on the fabric along one straight edge, the pockets each having an opening facing upward, (b) orienting the panel to position the one straight edge along a ground line, (c) supporting the panel at edges other than the one straight edge by adjacent structure, and (d) filling the pockets with a weighty material such as sand, pebbles, water or another material having weight, and other edges supported on parts of a rigid structure provides resistance to deformation or movement by impinging wind.

In one embodiment of the method the panel is one side panel of a tent structure, other side panels of the same tent structure are also enhanced with pockets, further comprising filling the pockets of the other side panels with weighty material. Also in one embodiment the panel is a flat panel having a width and a length, the one straight edge being one of the lengthwise edges, and the other lengthwise edge is implemented with fasteners compatible with fasteners arrayed along a rigid structure such as a camping trailer, further comprising fastening the panel to the rigid structure by the compatible fasteners with the one straight edge with weighted pockets lying along the ground line, blocking air movement through the area covered by the weighted, fastened panel.

In one embodiment of the method the panel is one of a plurality of panels of a tent structure made to be fastened to a rigid structure, further comprising fastening the tent structure to the rigid structure with the weighted packets along the ground line. Also, in one embodiment the panel has hook-and-loop fasteners along one or both short edges, further comprising connecting like panels end-to-end at the hook-and-loop fasteners. Also, in one embodiment the forming step comprises folding over an edge of the panel onto itself and accomplishing vertical stitching to close the outer edges of the fold and to close the interior of the folded panel at locations along the length, defining the individual pockets.

In another embodiment of the method the forming step comprises forming the pockets separately and attaching the separately formed pockets to the one straight edge of the panel by one or more retainers comprising clips, fasteners, cords, wires, or rods. In another embodiment the method further comprises manually removing the retainers holding the individual ones of or the plurality of pockets in position allowing the pockets to spill their contents.

DETAILED DESCRIPTION OF THE INVENTION

In various embodiments described in enabling detail below the inventor provides a unique portable wind barrier for blocking wind and debris carried by the wind blowing through or underneath a portable or fixed structure. The present invention is described using the following examples, which may describe more than one relevant embodiment falling within the scope of the invention.

Figure 1A:
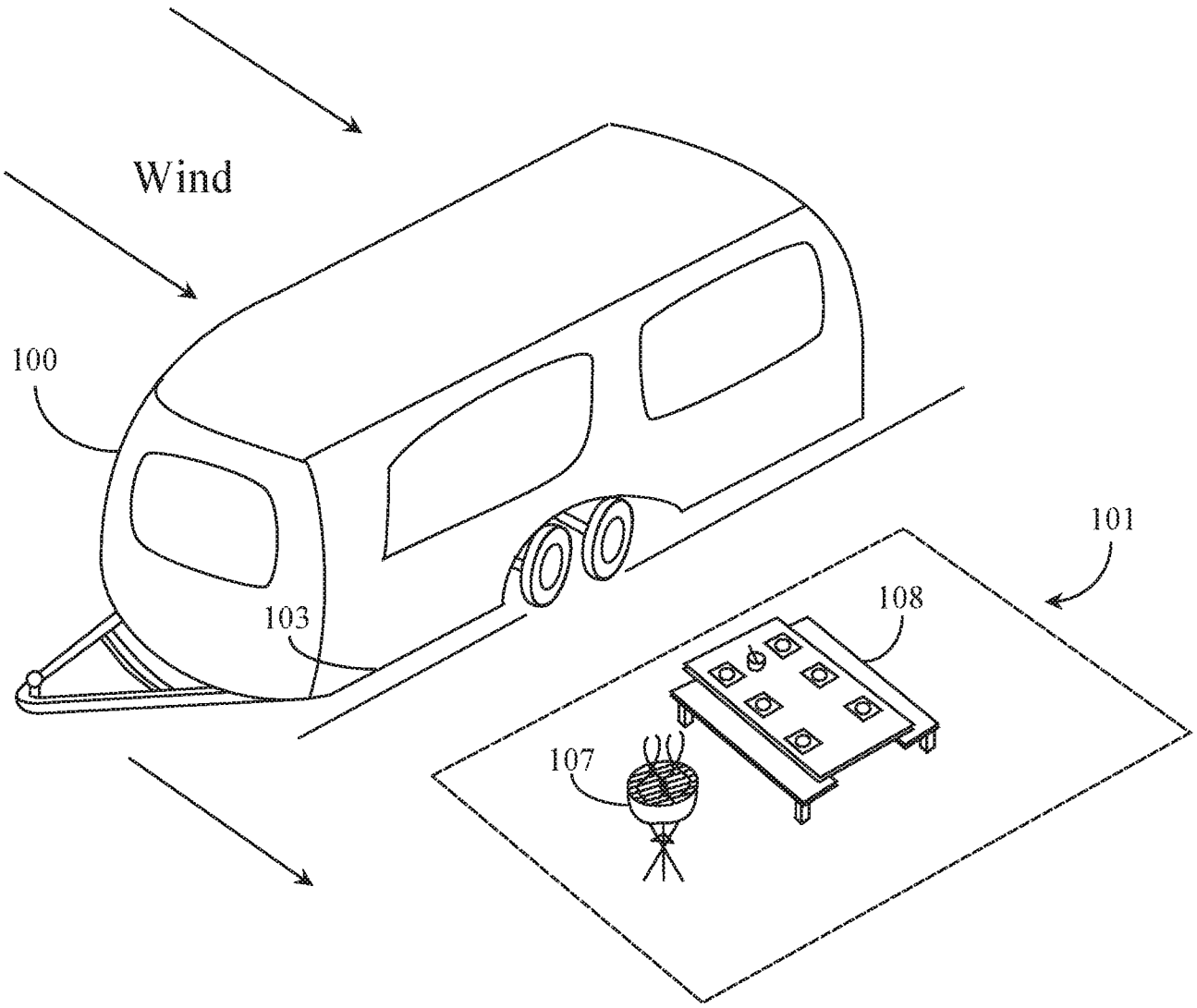
Fig. 1a (Prior Art)
FIG. 1*a* is a perspective view of a recreational vehicle next to an activity area in prior art.

FIG. 1*a* is a perspective view of a portable structure 100 adjacent to an activity area 101 in an example of the prior art Structure 100 in this example is a camping trailer and will be referred to hereinafter in this specification as trailer 100. Trailer 100 is an example of a portable structure that may have architecture open enough for wind to blow through or under. Trailer 100 is, in this example, parked with reference to wind direction to horizontally block the wind (illustrated by directional arrows).

In this example, it is desired to protect area 101 set up for dining and socialization. Area 101 in this example includes a picnic table 108 with place settings and an active barbeque fire 107. Area 101 is on the downwind side of the trailer relative to the oncoming winds. Trailer 100 is set up on an axle with wheels and has a prominent wheel well, making the architecture more open for wind tunneling, for example, wind passing through the wheel well and wind passing underneath the vehicle between the vehicle frame and ground.

Figure 1B:
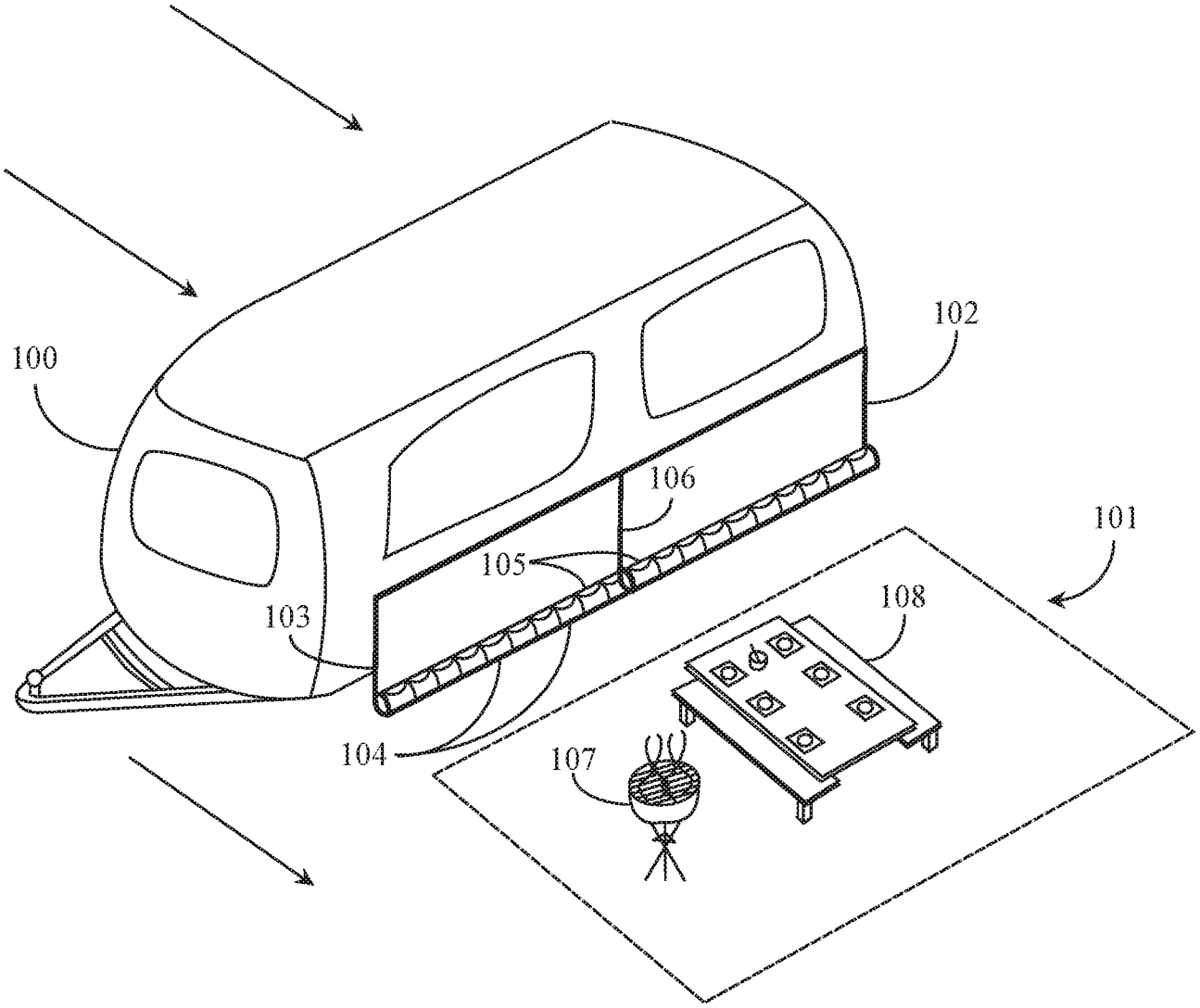
FIG. 1*b* is a perspective view of the recreational vehicle of FIG. 1*a* with wind barrier panels attached according to an embodiment of the present invention.

FIG. 1*b* depicts the trailer and activity area of FIG. 1, with wind barrier panels fastened to trailer 100. Trailer 100 is adapted to accept mounting of at least one wind barrier panel 102, but in this example two panels 102 and 103. Wind barrier panels 102 and 103 may be fastened or otherwise removably attached onto the downwind or upwind side of trailer 100. Attachment here is on the downwind side to better show details of attachment and use, but the wind barrier panels are considered by the inventor to function better fastened on the upwind side. In some embodiments, panels may be used on both sides, or all around the trailer. Panels 102 and 103 may be fastened to the side of trailer 100 using snap fasteners (not visible in this view) or other sorts of fasteners that may be manipulated to mount and release the panels. Wind barrier panels 102 and 103 may be fabricated from a heavy fabric such as canvas or another fabric heavy enough to withstand typical wind force. In one embodiment, panel 102 is fabricated from a flexible polymer/fabric blend or polymer-based material. In another embodiment the material used to fabricate wind barrier panel 102 is reinforced, such as by stitching layers of material over other layers of material in the construction. In one embodiment, the fabric materials used to form the panel have insulative qualities against cold and or fire-resistant qualities.

Wind barrier panels 102 and 103 are rectangular in this example and have a length and a height. The length of wind barrier panels 102 and 103 may vary according to need. In this example wind barrier panel 103 is fastened to trailer 100 immediately adjacent panel 102 and is connected to panel 102 at the interfacing vertical edges of the panels. Wind barrier panels 102 and 103 may be identical in description, such that they are of the same construction and materials, the same size, and are therefore interchangeable in installation whether installed singly or as a wind skirting comprising multiple panels.

Wind barrier panel 103 may, in one embodiment, differ in size of both height and length dimensions from panel 102 without departing from the spirit and scope of the present invention. For example, custom panel lengths and heights might be provided for structures depending on specific physical features of the structure's architecture that serves as the mounting location for the panels. In one embodiment, panels 102 and 103 have vertical edges with hook and loop fastener strips 106 overlaid and stitched or sewn thereto. For example, a front vertical edge my support loop material while the back vertical edge supports the hook material. In this way, multiple wind barrier panels such as panels 102 and 103 may be fastened to the side of RV 100 with the vertical edges connected together via hook and loop (commonly Velcro™).

A plurality of pockets 104 are formed or otherwise attached along the bottom horizontal edges of wind barrier panels 102 and 103. Each pocket 104 is adapted with an opening 105 facing toward the top edge of each panel. The pockets accept weighted material such as sand, pebbles, rocks, water or other materials or a combination of weighty materials. In this example, panels 102 and 103 are fastened onto the side of RV 100 at a height sufficient for presenting the pockets at or substantially near ground level. The weight inside the filled pockets helps to stabilize the barriers from the tunneling wind preventing them from flapping up during gusts, etc. Panels 102 and 103 may be rolled up conveniently and stowed when not being used after emptying the pockets, taking up little space.

There may be more or fewer pockets provided on panels 102 and 103 than are illustrated in this example without departing from the spirit and scope of the present invention. More detail about weighing the barriers down using the pockets is provided below.

Figure 2:
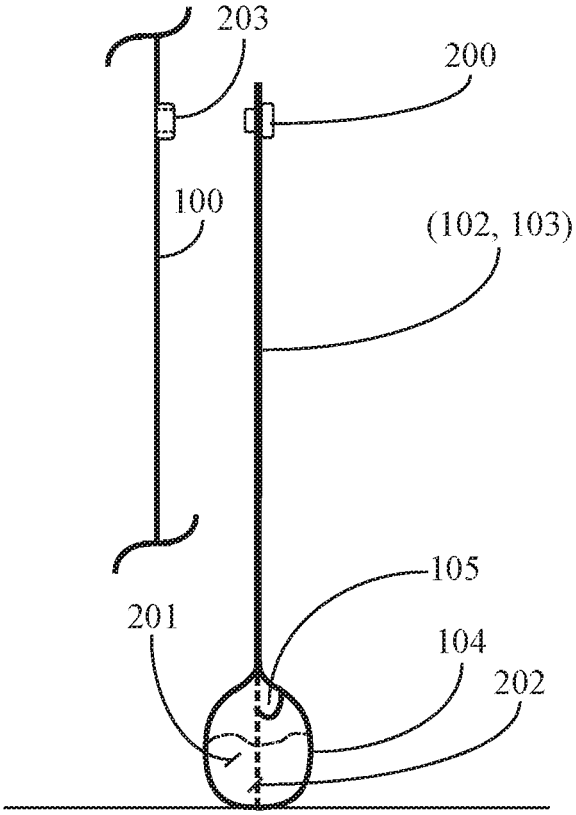
FIG. 2 is a side view of the wind-barrier panel of FIG. 1.

FIG. 2 is a side view of a wind barrier panel 102 or 103 of FIG. 1. Wind barrier panel (102, 103) may be fastened to the side of a recreation vehicle such as trailer 100 (partially illustrated in this view). In one embodiment the connector mechanisms are snap connectors or fasteners including a snap seat 203 attached to RV 100 and a snap button 200 pressed through or otherwise incorporated into wind barrier panels 102 and 103. Snap seats 203 are strategically mounted at substantially equal spacing in a horizontal row across the RV. Snap buttons are arranged in the same pattern as the snap seats in a row across the top edge of the panels.

In one embodiment, other methods for fastening panels (102, 103) to the side of RV 100 may be provided such as a connector seat strip bolted across the structure, the molded strip adapted to accept a similarly molded connector strip by pressing them together. In one embodiment connector mechanisms for attaching the panels to a structure may be magnetic, such as a magnetic strip adapted to accept magnetic buttons on the panels.

In this example pocket 104 is formed (may be sewn) into the bottom of the wind barrier and may bulge slightly at both the rear and front sides of the panel when filled with weighted materials. Openings 105 of pockets 104 present on the front side of wind barrier panel (102, 103) facing the top edge of the panel. This is not required to practice the present invention as the openings might present on the reverse side or on both sided of the panel (pockets on both sides). Pocket 104 is closed at the ends of panel (102, 103) by vertical stitching 202. Vertical stitching 202 is likewise provided along the length of the panel at substantially equal lengths to define the individual pockets or "pouches". In some embodiments there may be openings between pockets, so material may transfer from pocket to pocket. For example, in some uses the weighted material of choice for filling the pockets may be water, and these openings will allow water to equalize in height between the pockets.

Heavy materials 201 such as water, sand, pebbles or another material may cause the pockets to bulge out somewhat at both sides of the panel. The size of pocket 104, for example depth and girth, may vary without departing from the spirit and scope of the present invention. Pocket height may be uniform across the panel. In some applications 12" by 12" or one square foot pocket space may be used. For other applications larger or smaller pockets might be provided depending on need. A user may gauge the wind speed including occasional gusts of wind and weight one or more of the plurality of pockets by placing the material having weight into the desired pocket(s).

Figure 3:
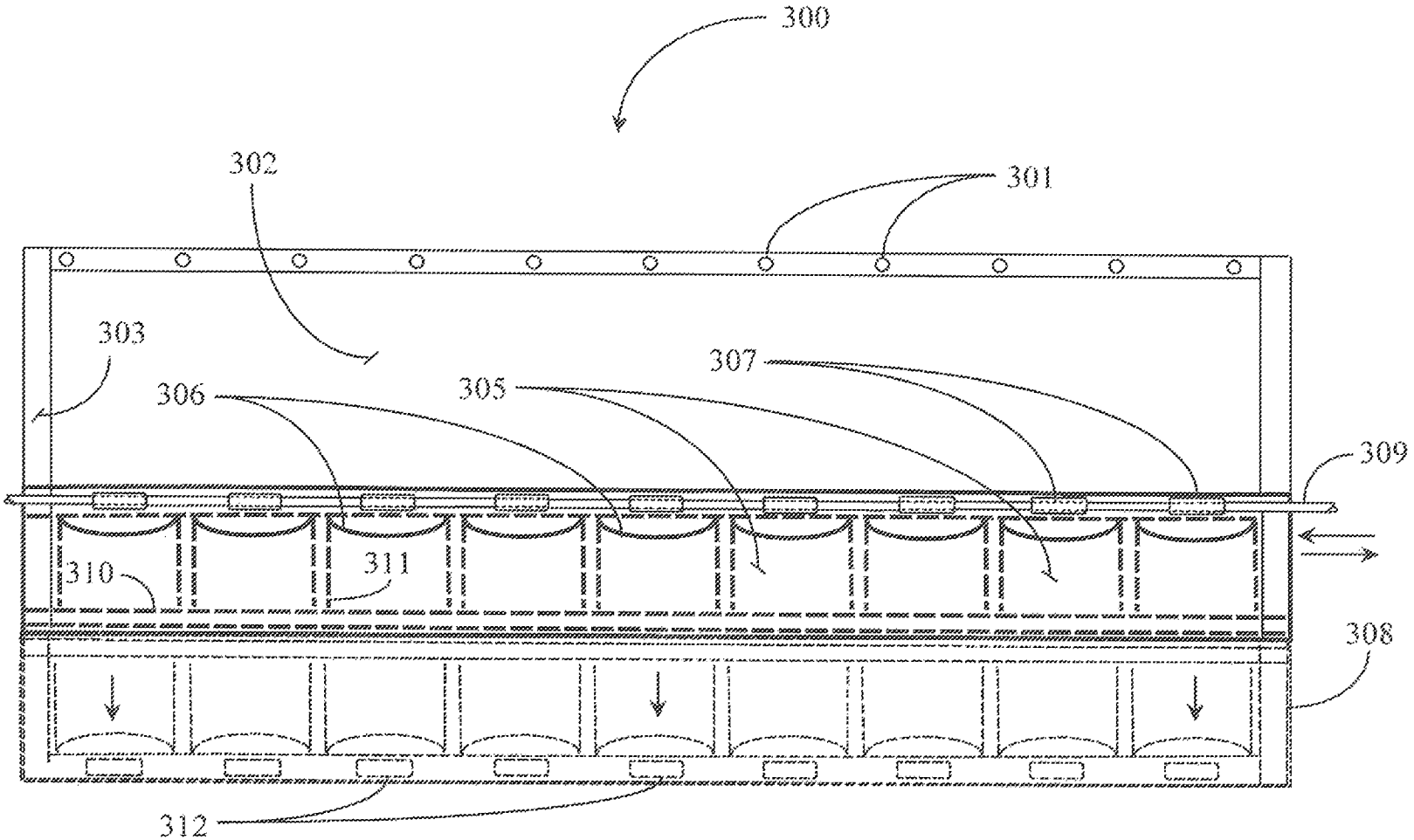
FIG. 3 is a front elevation view of a wind-barrier panel according to another embodiment of the present invention.

FIG. 3 is a front elevation view of a wind barrier panel 300 according to another embodiment of the present invention. Wind barrier panel 300 includes snap buttons 301 arranged in a row for fastening to a like row of snap seats pre-installed on a structure such as trailer 100 described previously in this specification. Snap buttons 301 are analogous to snap button 200 of FIG. 2. The materials used to fabricate panel 300, more particularly material 302, may be identical to those materials described previously with reference to fabricating panel (102, 103) of FIG. 1. However, panel 300 differs from the previously described panels in the way pockets 305 are constructed and how they might be collectively emptied of weighted material after use.

In this embodiment, the pockets are formed on the backside of wind barrier panel 300 as illustrated with a broken-boundary depiction of pocket orientation 308 before assembly and after evacuation of the pockets. Pockets 305 may be stitched, sewn onto, or attached to the backside of panel 300. Pockets 305 are stitched or sewn onto the panel in this embodiment via horizontal stitching 310 and via vertical stitching 311. It is noted herein that pockets 305 may be fabricated of the same material as panel 300 or of a different material without departing from the spirit and scope of the present invention. In this embodiment, a plurality of annular sleeves 307 are stitched, sewn, or otherwise attached to the front side of panel 300 in linear fashion, the sleeves equally spaced apart.

Sleeves 307 have an inside diameter great enough to accept a fastening rod 309 inserted through the sleeves. Sleeves 307 may be formed from the same fabric as the wind barrier panel. In one embodiment, sleeves 307 may be molded plastic parts attached to the panel material by fastener instead of by stitching or sewing. Fastening rod 309 may be a plastic, metal or wooden dowel without departing from the spirit and scope of the invention. In one embodiment rope, cord, wire or another implement may be used to secure the pocket in proper orientation and elevation on the panel.

In this example, the original height dimension of wind barrier panel 300 may be greater than the height dimension of the wind-barrier panels previously described, that is, at least by the height dimension of the pocket. The fold or crease in this embodiment occurs at the first horizontal stitch line marking the bottom edge of each pocket when the panel is folded. Therefore, the appropriate length for the panel in this example to block wind is the "folded" height of the panel. Wind barrier panel 300 includes a linear arrangement of openings 312 placed there through and equally spaced apart.

Openings 312 are visible in broken boundary and are adapted in size to fit over annular sleeves 307 when panel 300 is folded over onto itself with the edge adjacent to pocket openings 306 pressed over the like linear arrangement of annular sleeves 307. Rod 309 may be inserted through or removed from the annular sleeves in the direction of the associated directional arrows. Pockets 305 are held in proper orientation by inserting rod 309 into and through the linear arrangement of sleeves 307. A user may weigh the pockets while pocket openings 306 are held upright with rod 309 inserted through sleeves 307.

After use it may be desired to remove panel 300 from a structure and empty the weighted contents from pockets 305. A user may remove rod 309 to allow panel 300 to unfold under the weight of the full pockets. The panel may then be unsnapped from the structure and lifted up at least the height of the folded panel plus the height of the pocket to collectively finish evacuation of all of the pockets simultaneously. In one embodiment wind barrier panel includes two material sections (panel section 302, pocket section 308) hinged together at approximately the same location as the first horizontal stitch line from top to bottom with the panel unfolded. In other embodiment, other fastening schemes and supporting apparatus such as clips, cording, or hook and loop strip of industrial strength might be utilized to hold pockets 305 in proper orientation for weighting in place of a rod and sleeve without departing from the spirit and scope of the present invention.

Figure 4:
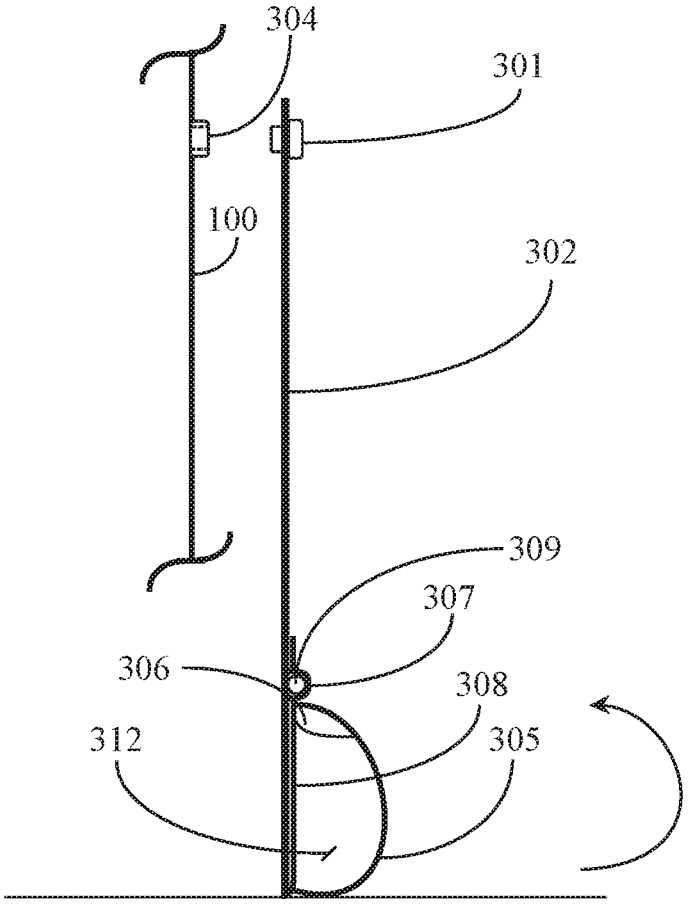
FIG. 4 is a side view of the wind-barrier panel of FIG. 3.

FIG. 4 is a side view of wind barrier panel 300 of FIG. 3. In this view snap button 301 is in alignment with a snap seat 304 installed on the side of a structure, in this case, trailer 100 described previously. Pocket 305 rests on or substantially near ground level (ground depicted by horizontal line). Weighted material 312 inside pocket 305 may cause it to bulge slightly out on the front side of the panel. In this example, material section 308 containing the pocket arrangement is folded over onto the front of panel 300 to bring the pockets into proper orientation with pocket openings 306 facing the top horizontal edge of the panel. Sleeves 307 are pressed through openings in the pocket section adapted for the purpose. Rod 309 may then be inserted through the sleeves to retain the fold and pocket arrangement in proper orientation for weighting the pockets. Removing rod 309 from sleeves 307 allows the pocket arrangement to fall (unfold) under its own weight spilling the contents of the pockets simultaneously. Unsnapping and lifting wind barrier panel 300 functions to finish evacuating the pockets as the pocket openings face down when the material is not folded.

Figure 5:
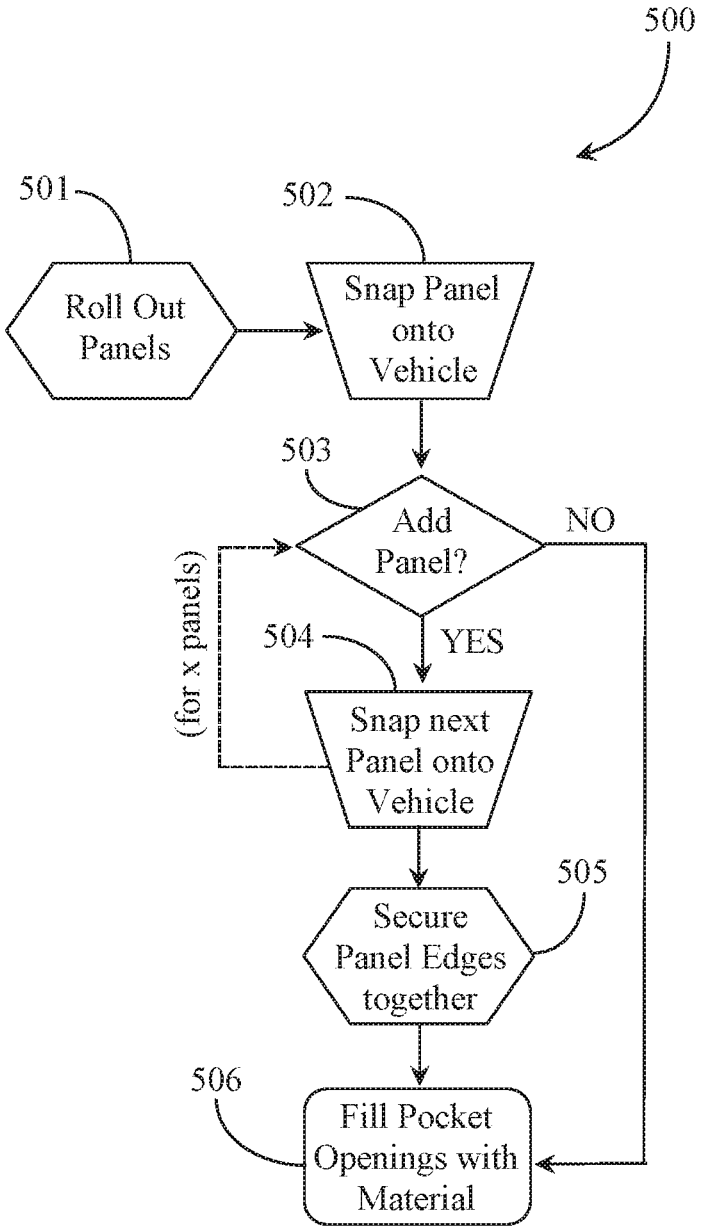
FIG. 5 is a process flow chart depicting steps for securing one or more panels to a structure.

FIG. 5 is a process flow chart 500 depicting steps for securing one or more panels to a structure. At step 501, a user may roll out one or more wind barrier panels for use. At step 502, the user may snap a first wind barrier panels onto the side of the structure, in this case, an RV analogous to RV 100 of FIG. 1. The linear arrangement of snap seats is pre-installed on the structure and is compatible to the linear arrangement of snap buttons provided on the panel. The user may decide in step 503 whether or not to add another panel. If the user decides to add another panel at step 503, then the user may snap the next panel into place at step 504.

At step 505, the user may connect the interfacing vertical edges of the adjacent panels together using the hook and loop fastener strips. Step 504 may loop back to step 503 for x number of panels added to the structure (RV). If the user determines not to add a panel at step 503, the process skips to step 506 where the user fills one or more of the pockets with material having weight. In the case of adding one or more panels, after the edges of the panels are secured to one another, the process moves to step 506 where the pockets are filled.

Whether a user might use only one panel or several panels in an installation depends entirely on the design and size of the structure supporting the panels. In one embodiment a rectangular structure set up off of the ground may have snap seats installed completely around the outside of the structure for accepting a complete wrap of wind barrier panels. In other implementations there may be occasions where only one panel is required.

Figure 6:
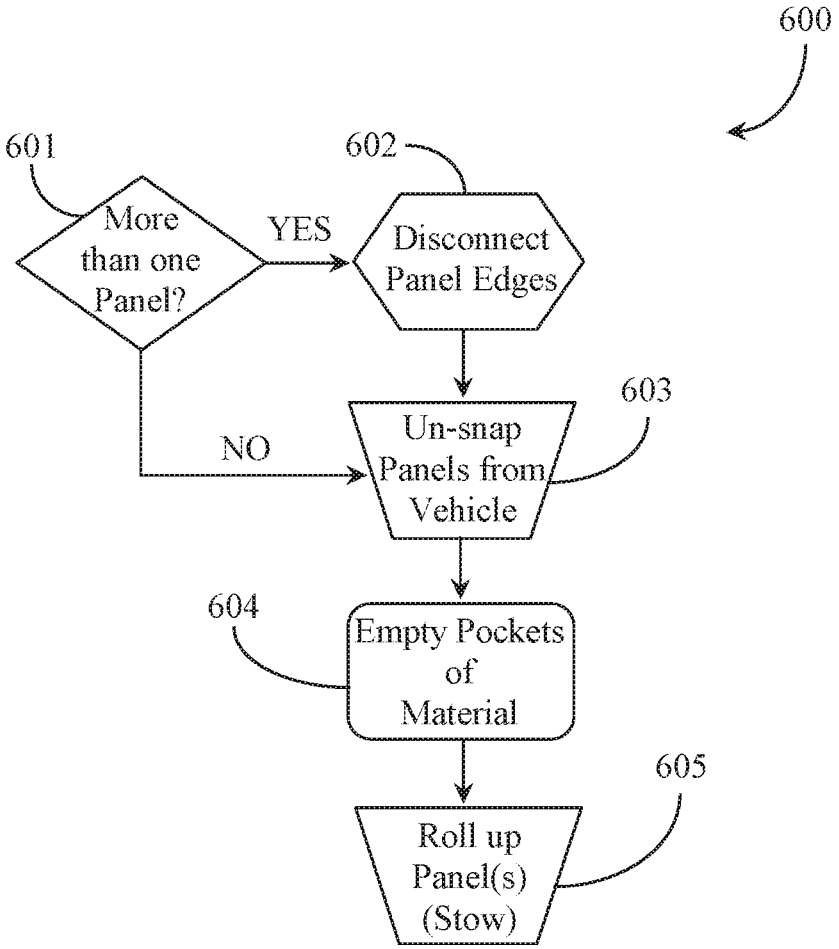
FIG. 6 is a process flow chart depicting steps for removing one or more panels from a structure.

FIG. 6 is a process flow chart 600 depicting steps for removing one or more panels from a structure. At step 601 it is determined whether there is more than one panel connected to the structure. If there is more than one panel in step 601, the user may disconnect the panel edged by pulling apart the hook and loop connector strips at step 602. If there is only one panel on the structure, the process skips to step 603 where the user unsnaps the panel from the structure. In the case of more than one panel, the user unsnaps one panel at a time in step 603.

After a panel is unsnapped from the structure at step 603, the pockets may be emptied of contents at step 604. Lying the panel down and turning it upside down to shake the contents out of the pockets may accomplish this. At step 605 the one or more panels may be rolled up tied and stowed for next use. In one embodiment of the invention a panel may be hung from a structure instead of using snap fasteners without departing from the spirit and scope of the present invention. Hooks connected to the panel and hook-securing apparatus connected to the structure may accomplish this.

Figure 7:
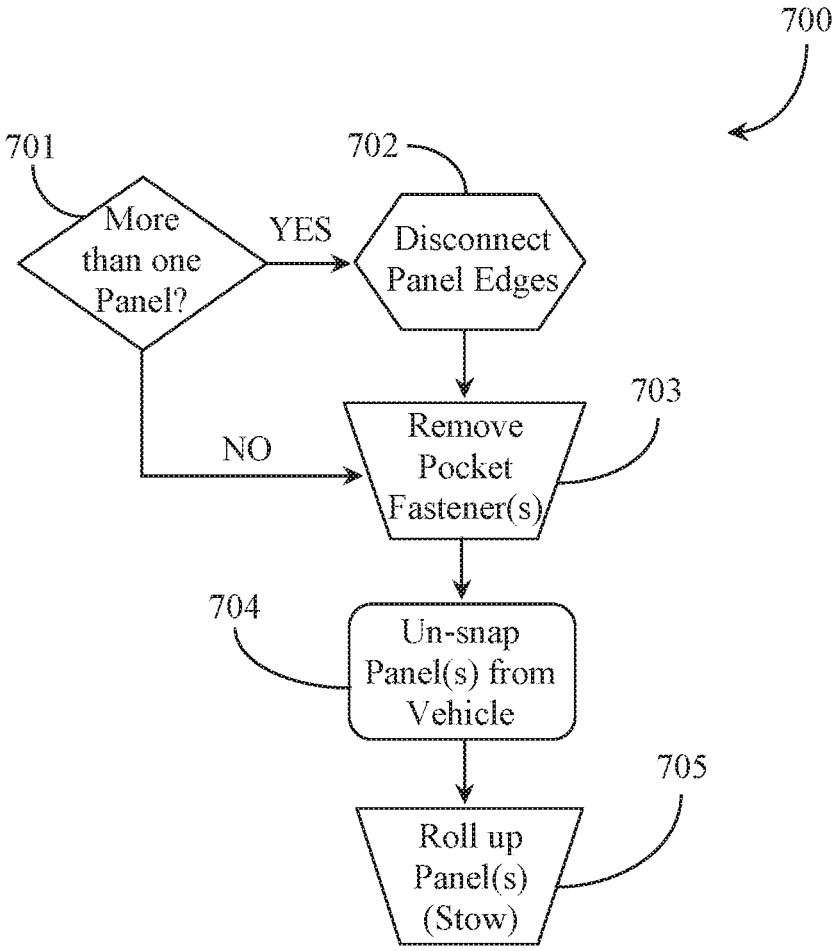
FIG. 7 is a process flow chart depicting steps for removing one or more panels from a structure according to another embodiment of the invention.

FIG. 7 is a process flow chart 700 depicting steps for removing one or more panels from a structure according to another embodiment of the invention. It is assumed in this embodiment that the panels used in this process conform to the folded design described previously with reference to panel 300 of FIG. 3.

At step 701 it is determined whether there is one or more than one panel for removal. If there is more than one panel connected to the structure as determined in step 701, the user may disconnect the panel edges by pulling apart the hook and loop fastener strips at step 702. If there is only one panel connected to the structure at step 701, the process may skip to step 703 where the user may remover a pocket fastener or fasteners allowing the pockets to fall down unfolding from the panel and at least partially spilling out the materials placed in the pockets.

In an embodiment where more than one panel is connected to the structure, one fastener such as a rod analogous to rod 309 of FIG. 3 might be used to span both panels locking them into the folded position. Step 703 might be performed before step 703 in a case where there is more than one connected panel. At step 704 the user may unsnap the panel or panels from the structure. The pockets may be fully evacuated if not already by lifting the panels up at least the height of the folded pocket section to turn the pockets completely upside down. The process then moves to step 705 where the user may roll up and stow the one or more panels for next use.

Figure 8:
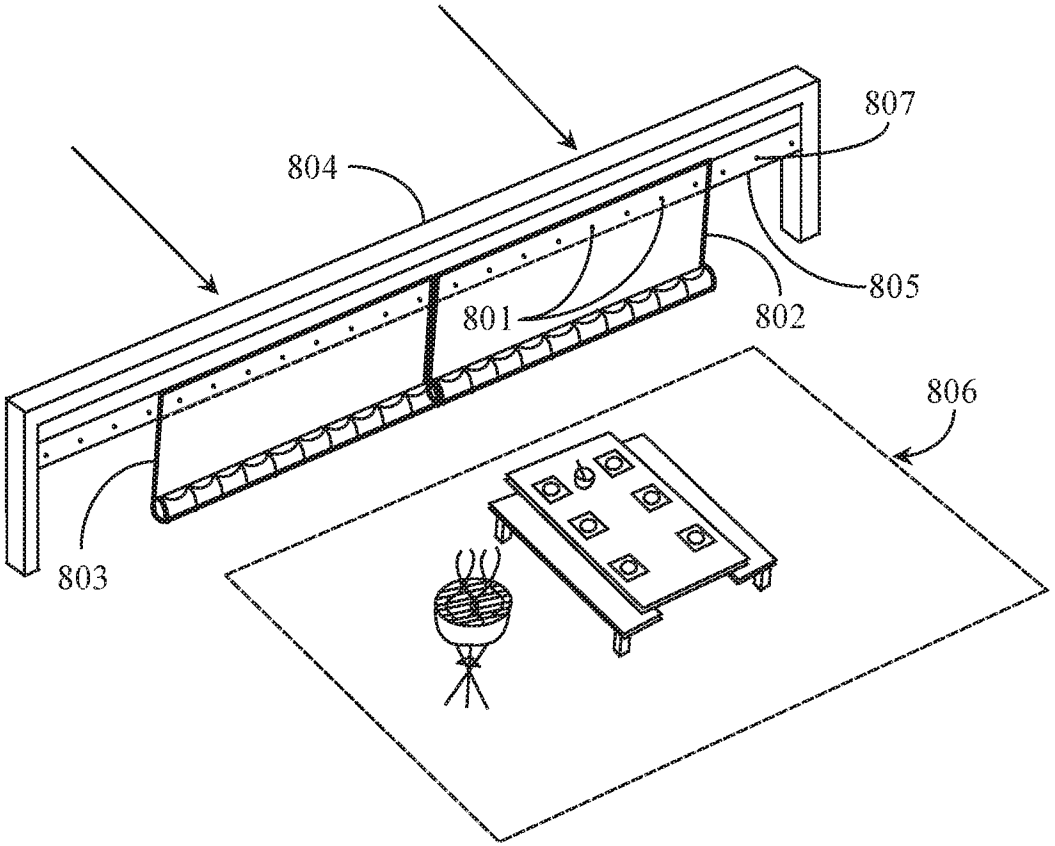
FIG. 8 is a perspective view of a portable or fixed construction with wind barrier panels attached thereto.

FIG. 8 is a perspective view of a structure 804 with wind barrier panels attached thereto. In this example structure 804 is a portable or a fixed construction, in this case a section of fencing or railing. Structure 804 is orientated substantially orthogonally relative to the direction of the wind (illustrated by directional arrows). In many case, fixed structures are so orientated in some areas such as coastal areas where wind direction is largely predictable such as long periods of steady on-shore winds or off-shore winds.

As was described previously with reference to area 101 of FIG. 1, the user has set up a dining and socialization area 806 on the downwind side of the structure. Structure 804 includes a horizontal rail 805 that is fixed to the structure and might serve as a mounting location for wind barrier panels 802 and 803. Rail 805 has a row of snap seats installed across the span of the rail. Panels 802 and 803 have matching rows of snap buttons 801 incorporated thereon for snapping the panels to the rail. In this example, it is assumed that the structure was adapted for the panels using the correct connectors and the correct spacing and height for the panels to be used.

In one embodiment there may be mounting strips or plates that contain the row of snap seats already installed there across. Such a strip or plate may be provided as a mounting interface and may be fastened to the structure using nails, screws, or other connector mechanisms at the correct height and orientation to accept panels 802 and 803 at the correct height enabling the pockets to rest on or otherwise reside near ground level. In one embodiment such a strip or plate might be installed across the distance between two trees in relatively close proximity to be enabled to block wind otherwise blowing between them.

Figure 9:
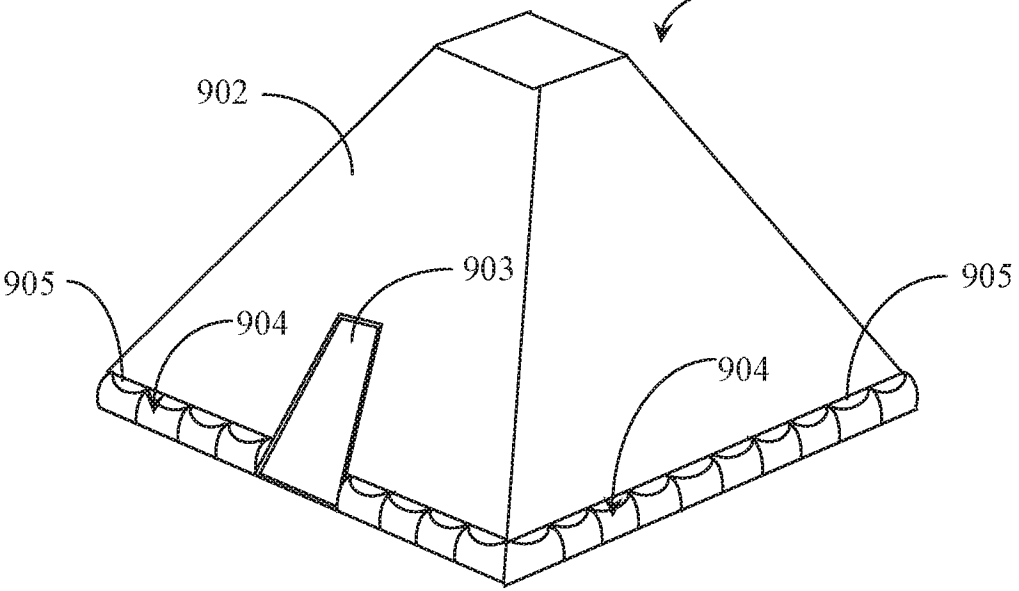
FIG. 9 is a perspective view of a tent in the shape of a truncated pyramid in one embodiment of the invention.

In another embodiment of the invention pockets may be provided in tent structures, particularly along bottom edges of side panels of tents, to weight the tent against effects of wind. In some instances, such structures may eliminate need for conventional staking of a tent. FIG. 9 is a perspective view of a tent in the shape of a truncated pyramid. This shape is merely an example of many shapes that tent structures may take. In exemplary tent 901 of FIG. 9 there are four sides, two of which are shown. conventional pole structures may be used (not shown) inside to form and support the shape of the tent. Pockets 904 with openings 905 are shown implemented along the bottom edges of the two sides shown. Side 902, however, has a break in the line of pockets to provide an opening 903 to provide access into and out of the tent structure.

Pockets 904 may be formed in any of the ways described above for pockets along edges of wind barrier panels, with openings 905 facing upward that may be used to fill the pockets with weighty material, such as sand, pebbles, water, etc., as described above. In many circumstances the pockets filled provide sufficient support against wind that stakes are no longer required. The skilled artisan will recognize that such a tent may be dismantled, and the side panels may be lifted in a way that the material in the pockets may be emptied. In the case of use with water, there may be openings in the pockets that may be closed to hold water and opened to drain the water at need.

Figure 10:
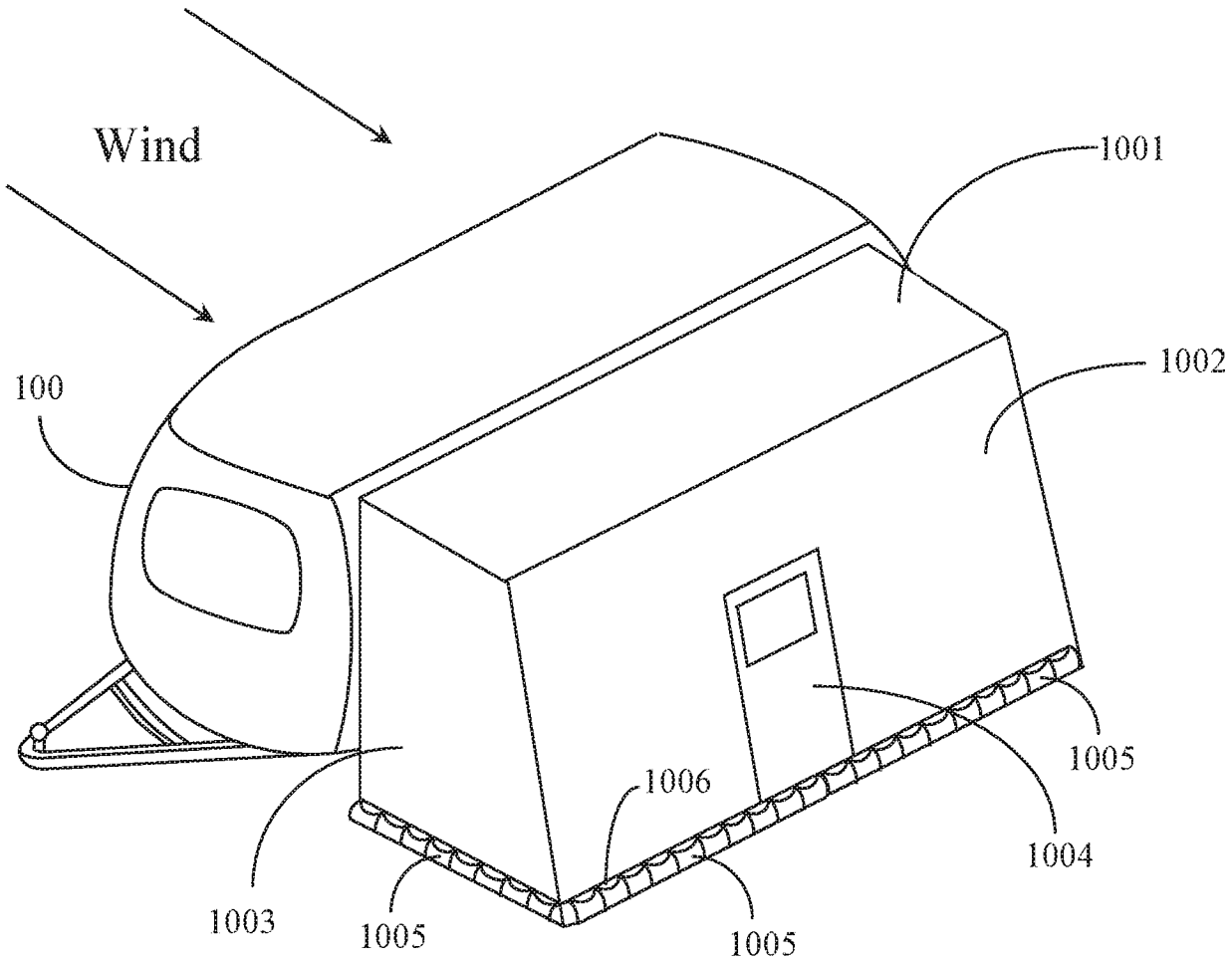
FIG. 10 is a perspective view of a tent structure made to integrate with a rigid structure in an embodiment of the invention.

FIG. 10 is a perspective view of a tent structure made to integrate with a rigid structure, in this case a trailer like trailer 100 of FIG. 1. In FIG. 10 a tent structure 1001 is implemented to assemble to trailer 100, and the fastening may be any method known in the art. Two sides of tent structure 1001 are shown in perspective, these being sides 1002 and 1003. Both of these sides, and the third side not seen in this figure, have each a row of pockets 1005 with openings 1006 facing upwards, such that the pockets may be filled with weighty material just as described for the sides of tent 901 of FIG. 9. The effect of the weight along the ground line along the sides of the tent structure is to stabilize the structure and resist movement potentially caused by impinging wind.

Wind barrier panels and tent structures may be provided in differing and custom lengths and heights for different applications without departing from the spirit and scope of the present invention. Wind barrier panels and tent structures may be applied to a flatbed trailer, an RV trailer, a racing truck, work vehicles such as water tenders or the like to block wind that can tunnel under such vehicles and through open structure of the vehicles. Wind barrier panels may also be applied to portable and fixed constructions like houses, mobile homes, fencing, railing, partially open walls, etc. Basically, pockets as taught in the examples described herein may be applied to any fabric that may be used in a structure that needs to have resistance to impinging wind.

It will be apparent to one with skill in the art that the wind barrier systems of the invention may be provided using some or all of the mentioned features and components without departing from the spirit and scope of the present invention. It will also be apparent to the skilled person that the arrangement of elements and functionality for the invention is described in different embodiments in which each is exemplary of an implementation of the invention. These exemplary descriptions do not preclude other implementations and use cases not described in detail. The invention is limited only by the breadth of the claims below.

The invention claimed is:

1. A method of stabilizing a panel against impinging wind and debris, the method comprising the steps of:

enhancing the panel by forming a row of pockets on said panel along one straight bottom edge, wherein the forming of the row of pockets is comprised of folding over an edge of the panel onto itself and accomplishing vertical stitching to close the outer edges of the fold and to close the interior of the folded panel at locations along the length, defining the individual pockets, the pockets each having an opening facing upward for holding material;

orienting the panel to position the one straight bottom edge to rest along a ground line or substantially near the ground line for blocking air movement and debris;

coupling the panel at edges other than the one straight bottom edge to a rigid structure; and filling the pockets with a weighty material comprised of sand, pebbles, or water to function as a ballast securing mechanism, whereby the other edges coupled to the rigid structure further provide resistance to deformation or movement by impinging wind and debris.

2. The method of claim 1, wherein the panel is flat and comprised of fabric, wherein the panel having a width and a length, the one straight bottom edge being one of the lengthwise edges, and the other lengthwise edges are implemented with fasteners compatible with fasteners arrayed along the rigid structure.

3. The method of claim 2 further including the step of fastening the panel to the rigid structure by the compatible fasteners with the one straight edge with weighted pockets lying along the ground line for blocking air movement and debris through the area covered by the weighted, fastened panel.

4. The method of claim 2 further including the step of rolling out at least one fabric panel for use.

5. The method of claim 2, wherein the other lengthwise edges of the panel are configured to be coupled to the rigid panel via hook and loop fastener strips, fasteners, snap fasteners, snap buttons, bolts, connector seat strips, molded connector strips or magnet strips.

6. The method of claim 1, wherein the rigid structure is a camping trailer, fence, rail or pole.

7. The method of claim 6 further including the step of using the panel as a wind skirt for the camping trailer.

8. The method of claim 1, wherein the panel is one of a plurality of panels of a tent structure configured to be coupled to the rigid structure.

9. The method of claim 1, wherein the material of the panel is comprised of canvas, fabric, polymer, flexible polymer, or a blend of polymer and fabric.

10. The method of claim 1, wherein the pockets are disposed substantially next to each other having openings, wherein the openings are configured to allow material to transfer from pocket to pocket, thereby enabling the material to equalize in height between the pockets.

11. The method of claim 1, wherein the forming of the row of pockets is comprised of forming the pockets separately and attaching the separately formed pockets to the one straight edge of the panel by one or more retainers comprising clips, fasteners, cords, wires, or rods.

12. The method of claim 11 further comprising manually removing the retainers holding the individual ones of or the plurality of pockets in position allowing the pockets to spill their contents.

13. A method of stabilizing a fabric panel against impinging wind and debris, the method comprising the steps of:

enhancing the fabric panel by forming a row of pockets on said fabric along one straight bottom edge, wherein the forming of the row of pockets is comprised of folding over an edge of the panel onto itself and accomplishing vertical stitching to close the outer edges of the fold and to close the interior of the folded panel at locations along the length, defining the individual pockets, the pockets each having an opening facing upward;

orienting the panel to position the one straight bottom edge to rest along a ground line or substantially near the ground line;

coupling the panel at edges other than the one straight bottom edge to a rigid structure;

filling the pockets with a weighty material comprised of sand, pebbles, or water to function as a ballast securing mechanism, whereby the other edges coupled to the rigid structure further provide resistance to deformation or movement by impinging wind and debris; and wherein the pockets are disposed substantially next to each other having openings, wherein the openings are configured to allow material to transfer from pocket to pocket, thereby enabling the material to equalize in height between the pockets.

14. The method of claim 13, wherein the rigid structure is a camping trailer, fence, rail or pole.

15. The method of claim 14, wherein the panel is used as a wind skirt for the camping trailer.

16. The method of claim 13 further including the step of using the panel as a wind skirt.

17. A method of stabilizing a fabric panel, the method comprising the steps of:

forming a row of pockets on the fabric panel along one straight bottom edge, wherein the forming of the row of pockets is comprised of folding over an edge of the panel onto itself and accomplishing vertical stitching to close the outer edges of the fold and to close the interior of the folded panel at locations along the length, defining the individual pockets, the pockets each having an opening facing upward for holding material;

orienting the panel to position the one straight bottom edge to rest along a ground line or substantially near the ground line for blocking air movement and debris;

coupling the panel at edges other than the one straight bottom edge to a rigid structure; and filling the pockets with a weighty material to function as a ballast securing mechanism, whereby the other edges coupled to the rigid structure further provide resistance to deformation or movement by impinging wind and debris.

18. The method of claim 17, wherein the weighty material is comprised of sand, pebbles, or water.

19. The method of claim 18, wherein the pockets are disposed substantially next to each other having openings, wherein the openings are configured to allow material to transfer from pocket to pocket, thereby enabling the material to equalize in height between the pockets, and wherein the rigid structure being a camping trailer, tent, fence, rail or pole.

* * * * *